US009328895B2

(12) United States Patent
Lin et al.

(10) Patent No.: US 9,328,895 B2
(45) Date of Patent: May 3, 2016

(54) ILLUMINATION DEVICE

(71) Applicant: Industrial Technology Research Institute, Hsinchu (TW)

(72) Inventors: Cheng-Hsuan Lin, Changhua County (TW); Hsun-Yu Lee, Taichung (TW); Ping-Chen Chen, Taipei (TW); Chun-Hsiang Wen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 14/532,011

(22) Filed: Nov. 4, 2014

(65) Prior Publication Data

US 2015/0055351 A1 Feb. 26, 2015

Related U.S. Application Data

(62) Division of application No. 13/610,911, filed on Sep. 12, 2012, now Pat. No. 9,046,238.

(30) Foreign Application Priority Data

Feb. 14, 2012 (TW) ..... 101104683 A

(51) Int. Cl.
*F21V 3/00* (2015.01)
*F21V 5/04* (2006.01)
(Continued)

(52) U.S. Cl.
CPC ..... *F21V 5/005* (2013.01); *F21K 9/135* (2013.01); *F21K 9/50* (2013.01); *F21V 3/02* (2013.01); *F21V 3/049* (2013.01); *F21V 5/002* (2013.01); *F21V 5/046* (2013.01); *F21Y 2101/02* (2013.01)

(58) Field of Classification Search
CPC ..... F21V 5/00–5/08; F21V 3/00–3/049; F21V 7/00–7/22
See application file for complete search history.

(56) References Cited

U.S. PATENT DOCUMENTS 8,575,836 B2 * 11/2013 van de Ven ..... 313/512
2011/0216523 A1 * 9/2011 Tong et al. ..... 362/84
(Continued)

FOREIGN PATENT DOCUMENTS

CN 201093221 7/2008
CN 201363661 12/2009
(Continued)

OTHER PUBLICATIONS

"Office Action of Chinese Counterpart Application", issued on Jan. 12, 2015, p. 1-p. 11.
(Continued)

*Primary Examiner* — Mariceli Santiago
(74) *Attorney, Agent, or Firm* — Jianq Chyun IP Office

(57) ABSTRACT

An illumination device including a base, at least one LED light source and a diffusing element is provided. The base has a supporting plane. The LED light source disposed on the supporting plane has a light emitting surface substantially parallel to the supporting plane. The diffusing element disposed on the supporting plane to cover the at least one LED light source. The diffusing element includes a first portion and a second portion. The first portion located above the at least one LED light source. The second portion connected between the first portion and the base. An optical characteristic of the first portion is different from that of the second portion so that a non-continuous boundary is defined between the first portion and the second portion.

6 Claims, 8 Drawing Sheets

(51) Int. Cl.

| | |
|---|---|
| ***F21V 5/00*** | (2015.01) |
| ***F21K 99/00*** | (2016.01) |
| ***F21V 3/02*** | (2006.01) |
| ***F21V 3/04*** | (2006.01) |
| *F21Y 101/02* | (2006.01) |

(56) References Cited

U.S. PATENT DOCUMENTS

| | | | | |
|---|---|---|---|---|
| 2012/0161626 | A1* | 6/2012 | van de Ven et al. | 315/35 |
| 2013/0188347 | A1* | 7/2013 | Bryan et al. | 362/235 |
| 2013/0201680 | A1* | 8/2013 | Allen et al. | 362/235 |

FOREIGN PATENT DOCUMENTS

| | | |
|---|---|---|
| CN | 201568895 | 9/2010 |
| CN | 102022689 | 4/2011 |
| JP | 2006324036 | 11/2006 |
| TW | 201033531 | 9/2010 |

OTHER PUBLICATIONS

"Office Action of China Counterpart Application", issued on Aug. 3, 2015, p. 1-p. 12.

Office Action of China Counterpart Application, issued on Jan. 5, 2016, p. 1-p. 11.

* cited by examiner

ILLUMINATION DEVICE

CROSS-REFERENCE TO RELATED APPLICATION

This application is a divisional of and claims priority benefit of an application Ser. No. 13/610,911, filed on Sep. 12, 2012, now allowed, which claims the priority benefit of Taiwan application serial no. 101104683, filed on Feb. 14, 2012. The entirety of each of the above-mentioned patent applications is hereby incorporated by reference herein and made a part of this specification.

BACKGROUND OF THE DISCLOSURE

1. Technical Field

The disclosure relates to an illumination device, and more particularly to an illumination device utilized with a light emitting diode (LED) light source.

2. Background

With the progress in semiconductor technology, the power attained by an LED becomes increasingly larger, and the intensity of the emitted light is getting even greater. In addition, the LED has the characteristics such as power saving, long lifetime, environment friendly, rapid response, small volume and the like. The LED is widely applied in the products including the illumination apparatus, the traffic lights, the displays, the optical mice, etc. for replacing the conventional fluorescent lamps or the incandescent bulbs. As for an LED bulb, several shortages are still existed. For instance, the direction of the light emitted from the LED per se is significantly anisotropic so that the light distribution of the LED bulb is not desirable.

Generally, the light distribution of the illumination apparatus can be represented by the beam angle thereof. FIG. 1 is a schematic diagram showing the measurement of the light distribution of the illumination apparatus. Referring to FIG. 1, the illumination apparatus L is placed in a dark room R and an illumination meter S measures the light emitted from the illumination apparatus L along the measuring trace T in the dark room R. A main light emitting direction A (the normal direction of the light emitting surface of the LED bulb) of the illumination apparatus L is defined as 0° and the measuring trace T is set to be located within the range of +150° to −150°. At this time, the illumination meter S is spaced from the illumination apparatus L at a distance d of 1 m, for example.

In a word, the measurement of the light distribution is performed by the illumination meter S spaced from the illumination apparatus L at a fixed distance d scanning along the range of +150° to −150° so as to obtain the light distribution curve of the illumination apparatus L. Herein, the angle range corresponding to where the illumination intensity is greater than half of the peak intensity in the light distribution curve can be served as the beam angle.

FIG. 2 is a schematic diagram showing the light distribution of an LED bulb in the related art. Referring to FIG. 2, the light distribution curve 10 shows the measured result of the LED bulb in the related art, wherein the illumination intensity measured at the angle range of +60° to −60° is greater than half of the peak intensity. Accordingly, it is noted that the beam angle of the LED bulb in the related art is about 120° based on the light distribution curve 10.

SUMMARY

The disclosure provides an illumination device including a base, at least one LED light source and a first diffusing element. The base has a supporting plane. The LED light source is disposed on the supporting plane of the base and a light emitting surface thereof is substantially parallel to the supporting plane of the base. The first diffusing element is disposed on the supporting plane of the base. The first diffusing element is a hollow column surrounding the at least one LED light source, and an inner diameter width of the first diffusing element is gradually reduced outward from the base, wherein the first diffusing element has a rough surface including a plurality of surface structures.

The disclosure further provides another illumination device including a base, at least one LED light source and a diffusing element. The base has a supporting plane. The LED light source is disposed on the supporting plane of the base and a light emitting surface thereof is substantially parallel to the supporting plane of the base. The diffusing element is disposed on the supporting plane of the base to cover the LED light source. The diffusing element includes a first portion and a second portion. The first portion is located above the LED light source. The second portion is connected between the first portion and the base, wherein an optical characteristic of the first portion is different from that of the second portion so that a non-continuous boundary is defined between the first portion and the second portion.

Several exemplary embodiments accompanied with figures are described in detail below to further describe the disclosure in details.

BRIEF DESCRIPTION OF THE DRAWINGS

The accompanying drawings constituting a part of this specification are incorporated herein to provide a further understanding of the disclosure. Here, the drawings illustrate embodiments of the disclosure and, together with the description, serve to explain the principles of the disclosure.

DETAILED DESCRIPTION OF THE EMBODIMENTS

Figure 1:
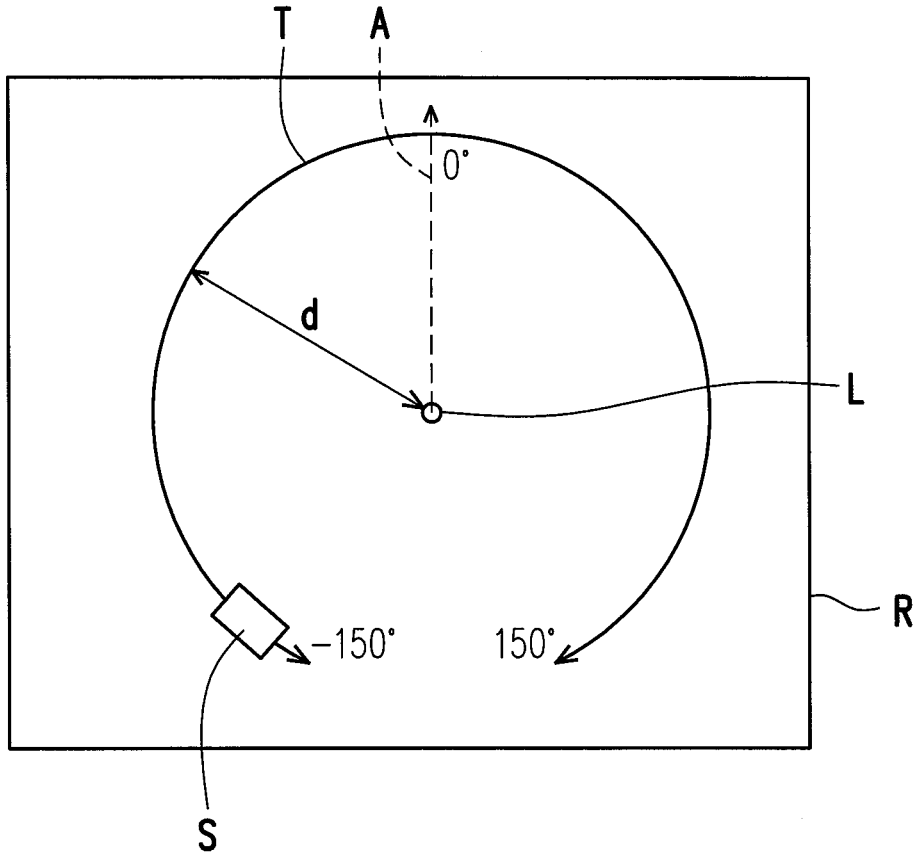
FIG. 1 is a schematic diagram showing the measurement of the light distribution of the illumination apparatus.
Figure 2:
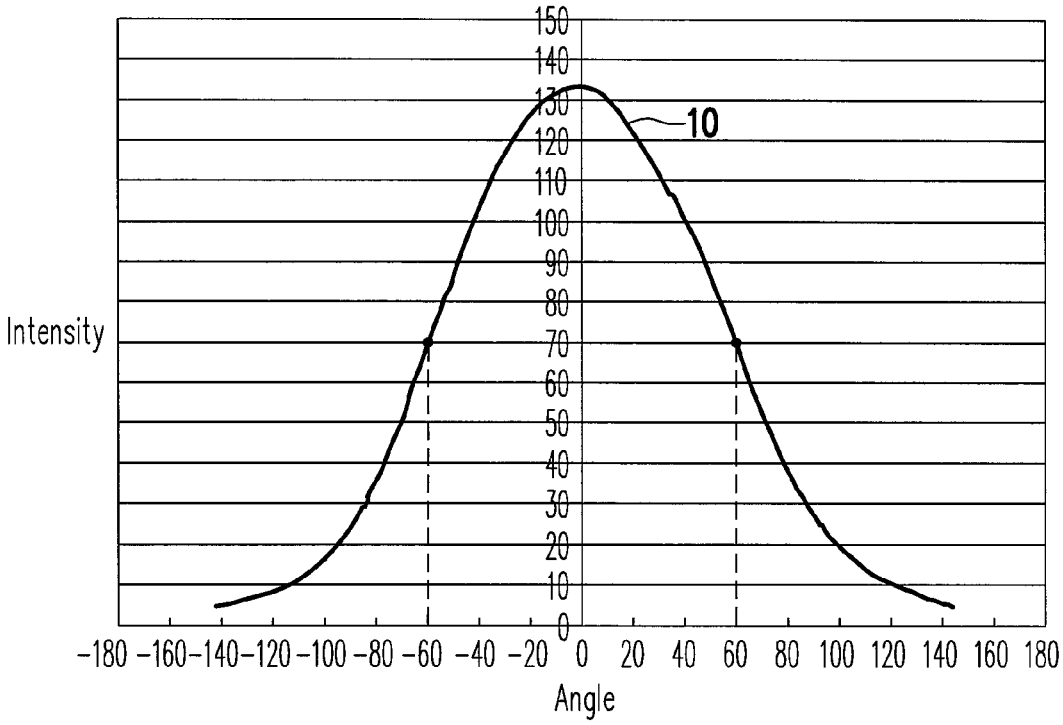
FIG. 2 is a schematic diagram showing the light distribution of an LED bulb in the related art.
Figure 3A:
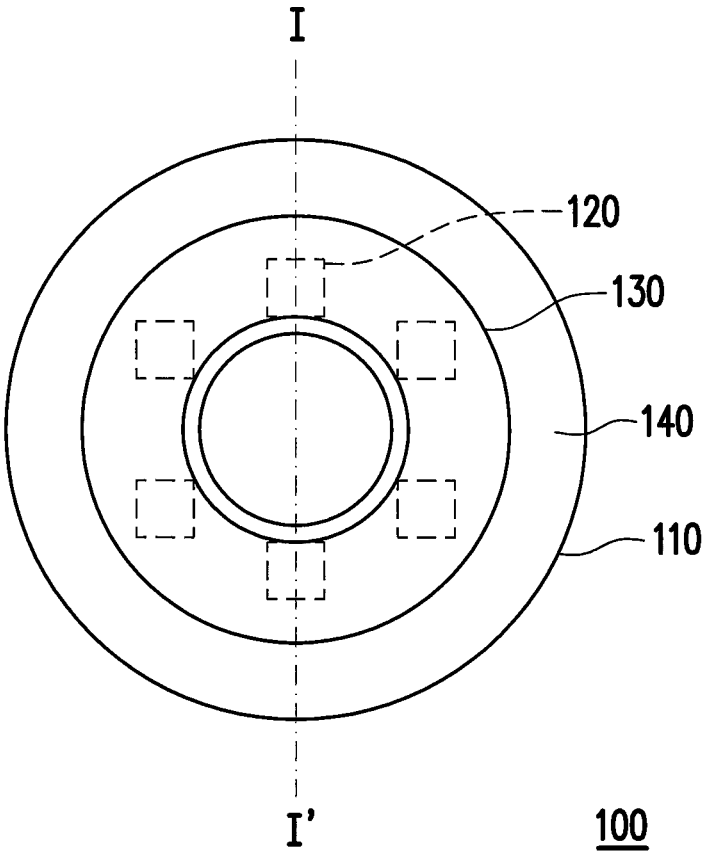
FIG. 3A is a schematic top view of an illumination device according to a first embodiment of the disclosure.
Figure 3B:
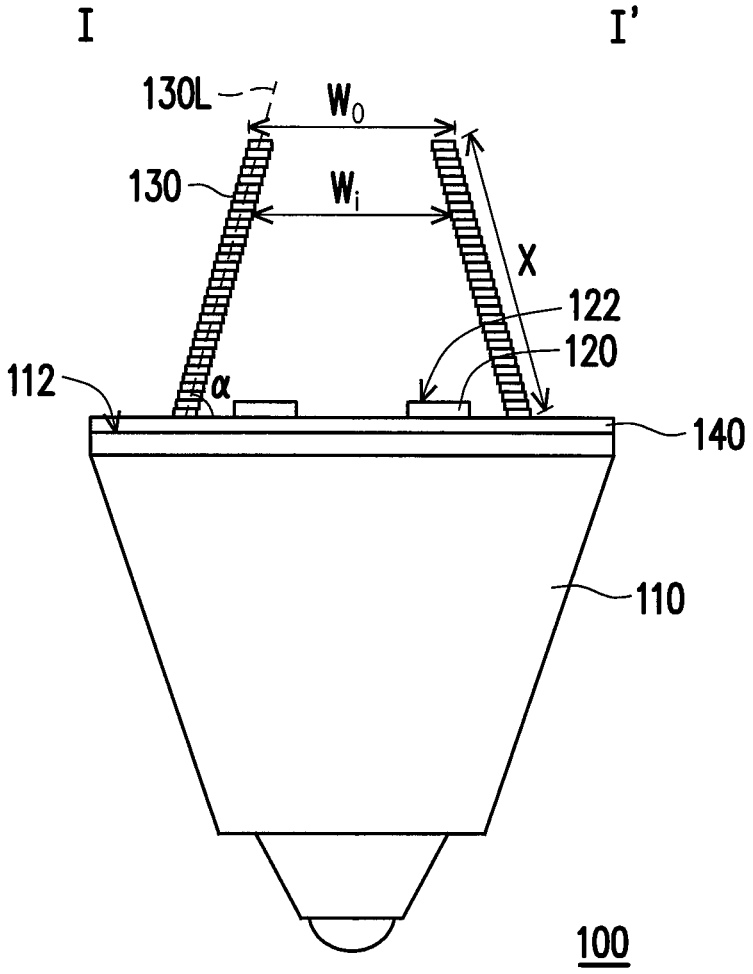
FIG. 3B is a schematic cross-sectional view illustrating the illumination device shown in FIG. 3A along the line I-I'.

FIG. 3A is a schematic top view of an illumination device according to a first embodiment of the disclosure, and FIG. 3B is a schematic cross-sectional view illustrating the illumination device shown in FIG. 3A along the line I-P. Referring to FIG. 3A and FIG. 3B, an illumination device 100 includes a base 110, at least one LED light source 120, a diffusing element 130, and a reflective layer 140. The LED light source 120, diffusing element 130 and the reflective layer 140 in the present embodiment are disposed on the base 110 and located at a same side of the base 110. The base 110 has a supporting plane 112 and the reflective layer 140 is disposed on the supporting plane 112 and parallel to the supporting plane 112. A number of the LED light source 120 configured in the present embodiment is a plural and the LED light sources 120 are disposed on the supporting plane 112 while a light emitting surface 122 of each LED light source 120 is substantially parallel to the supporting plane 112. The diffusing element 130 is, for example, a hollow column surrounding the LED light sources 120.

It is noted that the plurality of LED light sources 120 utilized in the present embodiment are exemplarily provided as an example and a number of the LED light source 120 can be one in other embodiments, which should not be construed as a limitation of the disclosure. Furthermore, the LED light sources 120 illustrated in the present embodiment are arranged in a ring, but the LED light sources 120 can be arranged in an array arrangement, a triangle arrangement or the like within the region surrounded by the diffusing element 130 in other embodiments.

The diffusing element 130 is, for example, a hollow column with a cone shape which has an inner diameter width Wi gradually reduced outward from the base 110. An outer diameter width Wo of the diffusing element 130 is also gradually reduced outward from the base 110. The diffusing element 130 conduces to conduct the light emitted from the LED light source 120 to form a cone-shaped light emitting structure. FIG. 3B is a schematic cross-sectional view of the illumination device 100 shown in FIG. 3A along the line I-I' which is perpendicular to the light emitting surface 122. Herein, a cross-sectional structure of the diffusing element 130 perpendicular to the supporting plane 112, for example, defines a linear trace 130L and an include angle a between the linear trace 130L and the supporting plane 112 is substantially from 30° to 70°. In addition, in the cross-sectional view depicted in FIG. 3B, an inclined length X of the cross-sectional structure of the diffusing element 130 perpendicular to the supporting plane 112 can be 20 mm to 70 mm. It is noted that the size and the shape of the diffusing element 130 can be modified according to the design requirement in other embodiments and the above described values and shapes are not construed as the limitation of the disclosure.

Figure 4A:
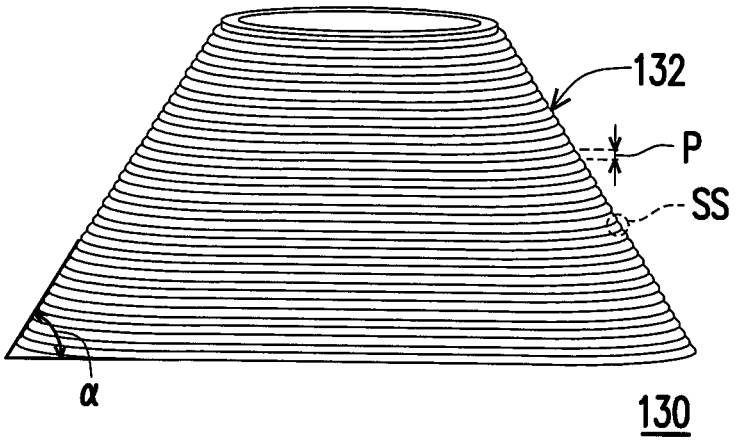
FIG. 4A is a schematic view of a diffusing element according to an embodiment of the disclosure.

FIG. 4A is a schematic view of a diffusing element according to an embodiment of the disclosure. Referring to FIG. 4A, the diffusing element 130 has a rough surface 132 including a plurality of surface structures SS according to the present embodiment. The configuration of the rough surface 132 is conducive to provide the light diffusing effect. Referring to FIG. 4A and FIG. 3B together, the diffusing element 130 can provide the light diffusing effect through the configuration of the stereo structures on the surface. Accordingly, the diffusing element 130 can be fabricated by using the injection forming or the related molded process to have the rough surface 132. According to the present embodiment, the diffusing element 130 need not be doped with the diffusing particles or coated with the diffusing coating layer. However, in other embodiments, the diffusing particles and the diffusing coating layer can be further selectively configured in the diffusing element 130.

Figure 4B:
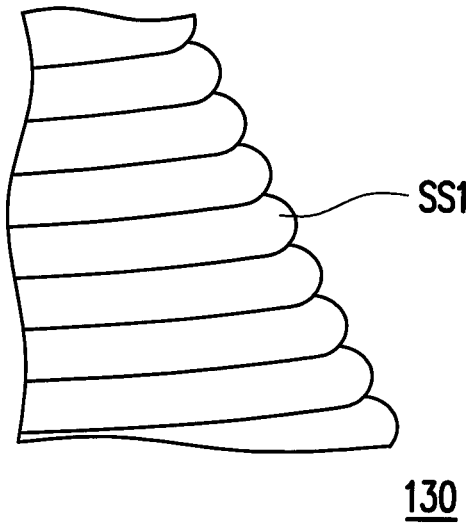
FIG. 4B and FIG. 4C are schematic views showing two surface structures of a diffusing element according to an embodiment of the disclosure.
Figure 4C:
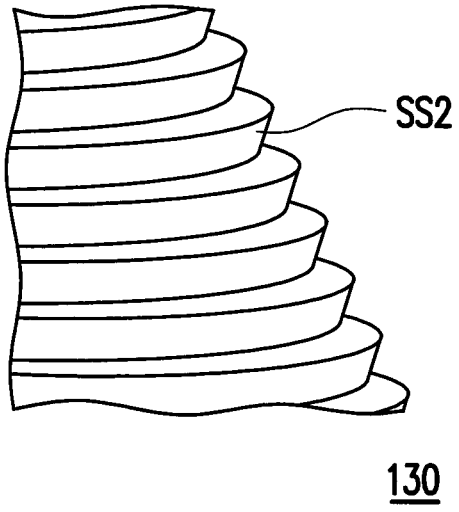

Specifically, FIG. 4B and FIG. 4C are schematic views showing two surface structures of a diffusing element according to an embodiment of the disclosure. According to FIG. 4B, the surface structures SS1 can be a plurality of arc structures so that the diffusing element 130 can have a structure constructed by stacking a plurality of rings with different radius. According to FIG. 4C, the surface structures SS2 can be a plurality of prism structures having sharp angles so that the diffusing element 130 can have a step-like structure. The surface structure SS according to the present disclosure is not limited to those depicted in FIG. 4A and FIG. 4B which are formed by a plurality of rings. In an alternate embodiment, the surface structure SS can be arranged in a scattered manner, a regional manner, or an irregular manner. In addition, the pitch P between the surface structures SS can be 25 μm to 1 mm, but the disclosure is not limited thereto.

In an embodiment, the configuration of the surface structures SS makes the diffusing element 130 providing specific optical characteristics such as light transmittance rate, haze, light diffusing efficiency, and the like. The following table 1 exemplarily shows the beam angle and the light emitting efficiency of the illumination device 100 according to an Example 1 which has the diffusing element 130 with a plurality of arc surface structures SS1 depicted in FIG. 4B and certain optical characteristics of the diffusing element 130 with the arc surface structures SS1. The following table 2 exemplarily shows the beam angle and the light emitting efficiency of the illumination device 100 according to an Example 2 which has the diffusing element 130 with a plurality of prism surface structures SS2 depicted in FIG. 4C and certain optical characteristics of the diffusing element 130 with the prism surface structures SS2.

TABLE 1

| Example 1 | Light Transmittance Rate (%) | Haze (%) | Light diffusing efficiency (%) |
|---|---|---|---|
| Diffusing element having the surface structures SS1 depicted in FIG. 4B | 74.12 | 85.54 | 63.40 |
| Beam angle (θ) of the illumination device | | 180° | |
| Light emitting efficiency of the illumination device | | 93.64% | |

TABLE 2

| Example 2 | Light Transmittance Rate (%) | Haze (%) | Light diffusing efficiency (%) |
|---|---|---|---|
| Diffusing element having the surface structures SS2 depicted in FIG. 4C | 92.3 | 99.36 | 91.71 |
| Beam angle (θ) of the illumination device | | 180° | |
| Light emitting efficiency of the illumination device | | 95.54% | |

Note:
the light emitting efficiency of the illumination device = lumen of the illumination device/lumen of the LED light sources.

The light transmittance rate and the haze can be measured through the NDH200 analyzer produced by NIPPON DENSHOKU INDUSTRIES Ltd. based on an ASTM D1003 analysis method and the light diffusing efficiency is measured through the GC-5000 analyzer produced by the NIPPON DENSHOKU INDUSTRIES Ltd. based on an ATSM C1044 analysis method. The lumen of the emitting light of the diffusing element (lampshade) is measured by the INV 12457 Ψ100 cm integrating sphere lumen measuring system of Light Ports Inc. Based on those listed in table 1 and table 2 and the structure illustrated in FIG. 3B, the illumination device 100 can provide a cone-like light emitting effect and has a beam angle of about 180° which is obviously increased relative to the related art. Accordingly, the light emitting effect of the illumination device 100 is more similar to the light emitting effect of the conventional incandescent bulb than the LED bulb in the related art so that the illumination device 100 according to the disclosure can provide wider illumination range.

Figure 5:
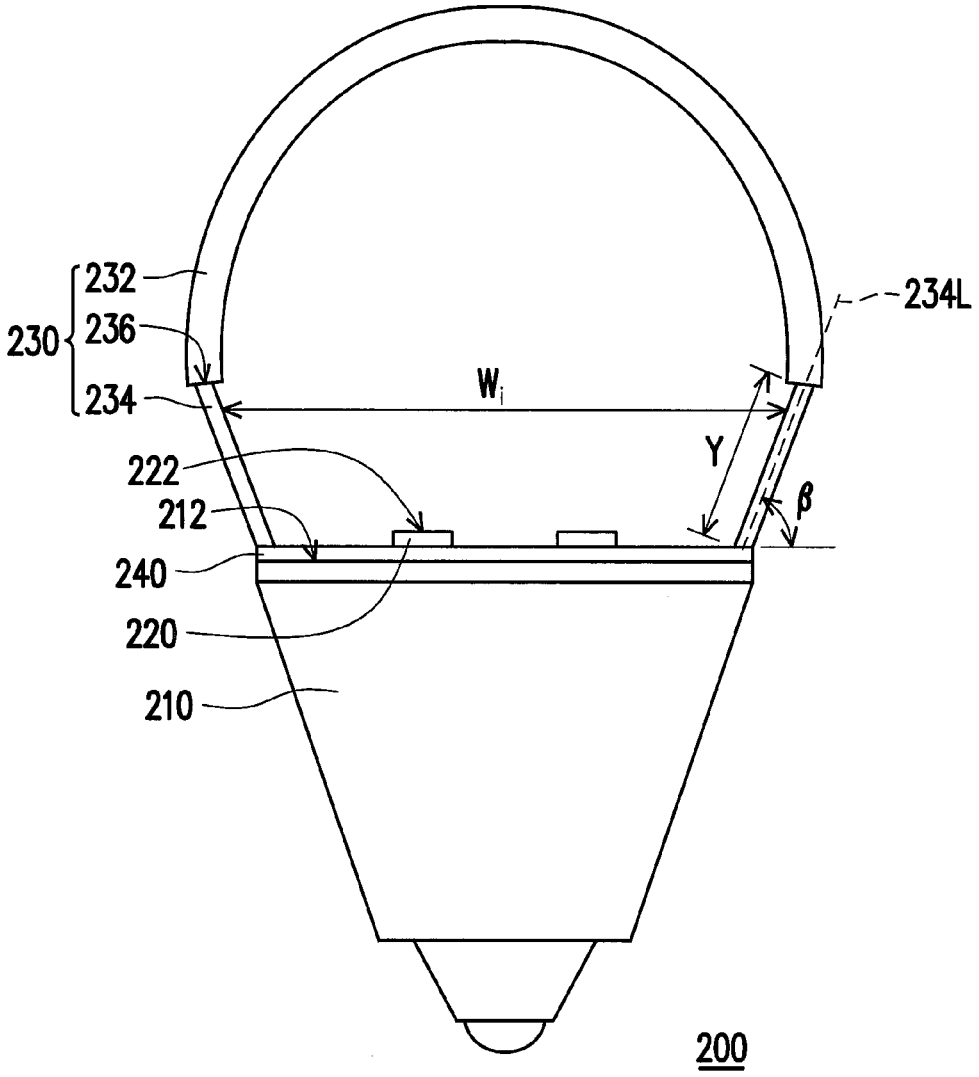
FIG. 5 is a schematic cross-sectional view of an illumination device according to a second embodiment of the disclosure.

FIG. 5 is a schematic cross-sectional view of an illumination device according to a second embodiment of the disclosure. Referring to FIG. 5, an illumination device 200 includes a base 210, at least one LED light source 220, a diffusing element 230, and a reflective layer 240. The LED light source 220, the diffusing element 230 and the reflective layer 240 are disposed on the base 210 in the present embodiment and are located at a same side of the base 210. The base 210 has a supporting plane 212 and the reflective layer 240 is disposed on and parallel to the supporting plane 212. A number of the LED light source 220 configured in the present embodiment is a plural and the LED light sources 220 are disposed on the supporting plane 212 while a light emitting surface 222 of each LED light source 220 is substantially parallel to the supporting plane 212. The diffusing element 230 is disposed on the supporting plane 212 of the base 210 to cover the at least one LED light source 220, and more particularly, the diffusing element 230 and the base 210 together sealed the LED light sources 220.

The diffusing element 230 includes a first portion 232 and a second portion 234. The first portion 232 is located above the LED light source 220. The second portion 234 is connected between the first portion 232 and the base 210, wherein an optical characteristic of the first portion 232 is different from that of the second portion 234 so that a non-continuous boundary 236 is defined between the first portion 232 and the second portion 234.

Referring to FIG. 5, for providing the light emitting effect similar to a bulb, the first portion 232 can have a hollow hemisphere shape and the second portion 234 is a hollow column structure connected between the first portion 232 and the base 210. An inner diameter width Wi of the second portion 234 can be gradually increased outward from the base 210, for instance. Therefore, the second portion 234 according to the present embodiment can be a cone structure with larger top and smaller bottom, wherein the bottom is defined as the portion relatively adjacent to the base 210.

Specifically, the cross-sectional structure depicted in FIG. 5 shows a cross-sectional view perpendicular to the supporting plane 212. Herein, a cross-sectional structure of the second portion 234 perpendicular to the supporting plane 212, for example, defines a linear trace 234L and an include angle β between the linear trace 234L and the supporting plane 212 is substantially from 45° to 90°. In addition, the inclined length Y of the cross-sectional structure of the second portion 234 perpendicular to the supporting plane 212 can be 20 mm to 40 mm and a spherical radius of the first portion 232 is from 20 mm to 40 mm. The arc structure of the first portion 232 can contain the range of 150° to 300° arc angle. It is noted that the size and the shape of the diffusing element 230 can be modified according to the design requirement in other embodiments and the above described values and shapes are not construed as the limitation of the disclosure.

Generally, the light emitting effect of the LED light source 220 can be presented by a focus light distribution. That is to say, the light intensity of the LED light source 220 measured right above the LED light source 220 (that is at the main light emitting direction) is the strongest and the light intensity of the LED light source 220 is gradually reduced outward from where is right above the LED light source 220. Therefore, the first portion 232 and the second portion 234 having different optical characteristics are conducive to adjust the light emitting effect of the illumination device 200 for complying with kinds of requirement.

The first portion 232 and the second portion 234 can have different light transmittance rates and the light transmittance rate difference therebetween can be at least 4% for achieving the different optical characteristics. In one embodiment, the light transmittance rate of the first portion 232 can selectively be smaller than that of the second portion 234. For example, the light transmittance rate of the first portion 232 is 50% and that of the second portion 234 is 54% or higher. By the configuration of the different light transmittance rates, the first portion 232 right above the LED light source 220 has a lower light transmittance rate and the second portion 234 surrounding the LED light source 220 has a higher light transmittance rate. The diffusing element 230 can adjust the light distribution of the LED light source 220 for achieving greater beam angle of the illumination device 200.

Alternately, the first portion 232 and the second portion 234 can have different haze and the haze difference therebetween can be at least 5% for achieving the different optical characteristics. In one embodiment, the haze of the first portion 232 can be greater than that of the second portion 234. For example, the haze of the first portion 232 is 90% and that of the second portion 234 is 85% or lower. By the configuration of the different haze, more quantity of light emitted from the LED light source 220 is emitted from the second portion 234 for enhancing the beam angle of the illumination device 200.

Furthermore, the first portion 232 is different from the second portion 234 in an optical characteristic such as the light diffusing efficiency, wherein the light diffusing efficiency difference between the first portion 232 and the second portion 234 can be at least 5%. In the present embodiment, the light diffusing efficiency of the first portion 232 can be greater than that of the second portion 234 so that the light emitting to the first portion 232 can be significantly diffused for obtaining greater beam angle through adjusting the light distribution of the LED light source 220. For example, the light diffusing efficiency of the first portion 232 is 95% and that of the second portion 234 is 90% or lower.

It should be noted that, the optical characteristics mentioned above are used for illustration, and are not intended to limit the scope of the disclosure.

Additionally, the optical characteristics mentioned above can be accomplished by various methods. In an example, the first portion 232 and the second portion 234 can be made of the same material, but have different thickness for achieving the different optical characteristics. Alternately, the first portion 232 can be doped with diffusing particles in a concentration different from the second portion 234, which renders the first portion 232 have the optical characteristic different from the second portion 234.

Furthermore, the first portion 232 and the second portion 234 can have different appearances for providing different optical characteristics, wherein the rough surface of the first portion 232 can have a roughness different from that of the second portion 234. In addition, the first portion 232 can selectively have a surface coating layer consisted of a material different from the surface coating layer of the second portion 234. In the present embodiment, the first portion 232 and the second portion 234 are two independent components and can be fabricated through two independent processes. Therefore, a non-continuous boundary 236 can be defined between the first portion 232 and the second portion 234. It is noted that the optical characteristic need not be changed gradually around the boundary 236 between the first portion 232 and the second portion 234 so that the fabrication of the illumination device is not complicated. In one embodiment of the disclosure, the first portion 232 and the second portion 234 can respectively have uniformed optical characteristics.

The following table 3 and table 4 exemplarily show the beam angle and the light emitting efficiency of the illumination device 200 according to two Examples 3 and 4 and certain optical characteristics of the first portion 232 and the second portion 234 of the diffusing element 230 configured in these Examples.

TABLE 3

| Example 3 | Light Transmittance Rate (%) | Haze (%) | Light diffusing efficiency (%) |
|---|---|---|---|
| First portion 232 | 54.41 | 99.54 | 95.13 |
| Second portion 234 | 90.11 | 82.21 | 15.18 |
| Beam angle (θ) of the illumination device | | 210° | |
| Light emitting efficiency of the illumination device | | 79.23% | |

TABLE 4

| Example 4 | Light Transmittance Rate (%) | Haze (%) | Light diffusing efficiency (%) |
|---|---|---|---|
| First portion 232 | 86.03 | 98.04 | 27.17 |
| Second portion 234 | 90.11 | 82.21 | 15.18 |
| Beam angle (θ) of the illumination device | | 160° | |
| Light emitting efficiency of the illumination device | | 93.6% | |

Based on those listed in table 3 and table 4, the illumination device 200 according to the present embodiment can have increased beam angle which prevents from the small beam angle problem of the LED bulb in the related art.

Figure 6:
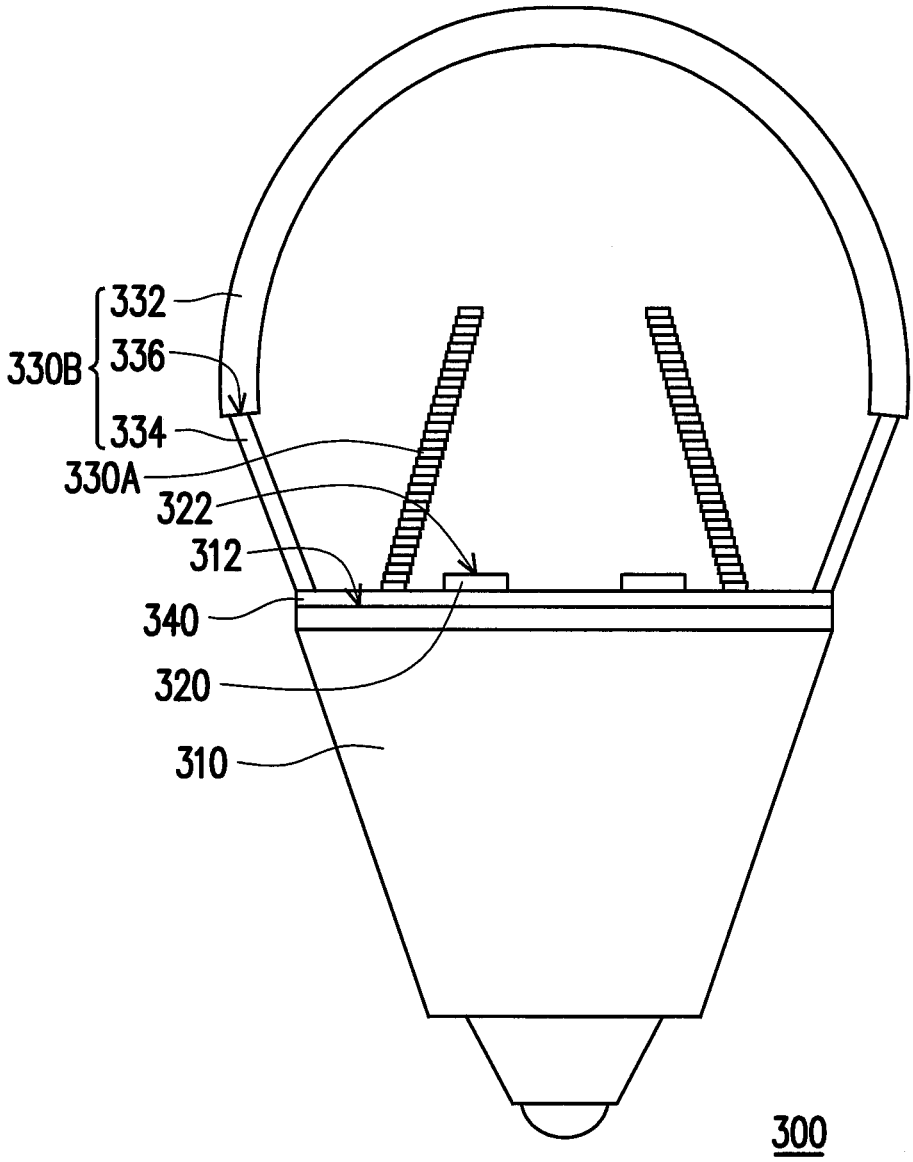
FIG. 6 is a schematic cross-sectional view of an illumination device according to a third embodiment of the disclosure.

FIG. 6 is a schematic cross-sectional view of an illumination device according to a third embodiment of the disclosure. Referring to FIG. 6, an illumination device 300 includes a base 310, at least one LED light source 320, a first diffusing element 330A, a second diffusing element 330B, and a reflective layer 340. The LED light source 320, the first diffusing element 330A, the second diffusing element 330B, and the reflective layer 340 are disposed on the base 310 in the present embodiment and are located at a same side of the base 310. The base 310 has a supporting plane 312 and the reflective layer 340 is disposed on and parallel to the supporting plane 312. A number of the LED light source 320 configured in the present embodiment is a plural and the LED light sources 320 are disposed on the supporting plane 312 while a light emitting surface 322 of each LED light source 320 is substantially parallel to the supporting plane 312. The first diffusing element 330A is, for example, a hollow column surrounding the LED light sources 320. The second diffusing element 330B is disposed on the supporting plane 312 of the base 310 to cover the at least one LED light source 320 and the first diffusing element 330A, and more particularly, the second diffusing element 330B and the base 310 together sealed the LED light sources 320 and the first diffusing element 330A.

In the present embodiment, the first diffusing element 330A and the second diffusing element 330B can be referred as the diffusing element 130 and the diffusing element 230 depicted in the above embodiments, respectively. Accordingly, the first diffusing element 330A has the characteristics similar to the diffusing element 130 and the second diffusing element 330B has the characteristics similar to the diffusing element 230. By the configuration of the components, the illumination device 300 can have good light emitting effect. The following table 5 exemplarily shows the beam angle and the light emitting efficiency of the illumination device according to an Example 5 and certain optical characteristics of the first diffusing element 330A and the second diffusing element 330B of the Example 5. The following table 6 exemplarily shows the beam angle and the light emitting efficiency of the illumination device according to an Example 6 and certain optical characteristics of the first and the second diffusing elements 330A and 330B of the Example 6, wherein the first diffusing element of the illumination device according to the Example 5 has a plurality of arc surface structures SS1 depicted in FIG. 4B and the first diffusing element of the illumination device according to the Example 6 has a plurality of sharp prism surface structures SS2 depicted in FIG. 4C.

TABLE 5

| Example 5 | Light Transmittance Rate (%) | Haze (%) | Light diffusing efficiency (%) |
|---|---|---|---|
| First diffusing element 330A having the surface structures SS1 depicted in FIG. 4B | 92.3 | 99.36 | 91.71 |
| First portion 332 of the second diffusing element 330B | 86.03 | 98.04 | 27.17 |
| Second portion 334 of the second diffusing element 330B | 90.11 | 82.21 | 15.18 |
| Beam angle (θ) of the illumination device | | 210° | |
| Light emitting efficiency of the illumination device | | 83.69% | |

TABLE 6

| Example 6 | Light Transmittance Rate (%) | Haze (%) | Light diffusing efficiency (%) |
|---|---|---|---|
| First diffusing element 330A having the surface structures SS2 depicted in FIG. 4C | 74.12 | 85.54 | 63.40 |
| First portion 332 of the second diffusing element 330B | 86.03 | 98.04 | 27.17 |
| Second portion 334 of the second diffusing element 330B | 90.11 | 82.21 | 15.18 |
| Beam angle (θ) of the illumination device | | 220° | |
| Light emitting efficiency of the illumination device | | 87.43% | |

Based on those listed in tables 1 through 6, the illumination devices 100, 200, and 300 according to the embodiments can have increased beam angle relative to the design of the related art. For example, the beam angle of the illumination device can be 160° to 220°, which prevents from the small beam angle problem of the LED bulb in the related art.

In summary, the illumination device according to the disclosure using the LED light source for providing the light has the characteristics such as great light emitting efficiency, power saving, etc. The diffusing element configured in the illumination device according to the disclosure conduces to adjust the light distribution of the LED light source for achieving the beam angle greater than 150°. Accordingly, the light emitting effect of the illumination device according to the disclosure is similar to that of the incandescent bulbs for replacing the conventional fluorescent lamps or the incandescent bulbs and becoming the illumination device with high quality, low power consumption, and wide illumination range.

It will be apparent to those skilled in the art that various modifications and variations can be made to the structure of the disclosed embodiments without departing from the scope or spirit of the disclosure. In view of the foregoing, it is intended that the disclosure cover modifications a variations of this disclosure provided they fall within the scope of the following claims and their equivalents.

What is claimed is:

1. An illumination device, comprising:

a base, having a supporting plane;

at least one LED light source disposed on the supporting plane of the base and a light emitting surface of the LED light source being substantially parallel to the supporting plane of the base; and a diffusing element disposed on the supporting plane of the base to cover the at least one LED light source, wherein the diffusing element comprises:

a first portion located above the at least one LED light source; and a second portion connected between the first portion and the base, a light transmittance rate difference between the first portion and the second portion being at least 4% to 40%, wherein an optical characteristic of the first portion is different from that of the second portion so that a non-continuous boundary is defined between the first portion and the second portion.

2. The illumination device as claimed in claim 1, wherein the optical characteristic of the first portion different from that of the second portion complies with at least one condition that comprises:

a haze difference between the first portion and the second portion being at least 5%; and a light diffusing efficiency difference between the first portion and the second portion being at least 5%.

3. The illumination device as claimed in claim 1, wherein the diffusing element complies with at least one condition that comprises:

the first portion having a thickness different from the second portion;

the first portion being doped with diffusing particles in a concentration different from the second portion;

the first portion having a rough surface with a roughness different from the second portion;

the first portion having a surface coating layer consisted of a material different from the second portion; and the first portion having a surface coating layer with a thickness different from the second portion.

4. The illumination device as claimed in claim 1, wherein the first portion has a hollow hemispherical shape, the second portion has a hollow column shape, and an inner diameter width of the second portion is gradually increased outward from the base.

5. The illumination device as claimed in claim 4, wherein a cross-sectional structure of the second portion perpendicular to the supporting plane defines a linear trace and an include angle between the linear trace and the supporting plane is substantially from 45° to 90°.

6. The illumination device as claimed in claim 4, wherein a spherical radius of the first portion is from 20mm to 40mm and a cross-sectional structure of the second portion perpendicular to the supporting plane has a length of 20mm to 40mm.

* * * * *